United States Patent [19]

Dow

[11] 4,018,021

[45] Apr. 19, 1977

[54] BUILDING AND METHOD OF MAKING SAME

[76] Inventor: Jimmy Dow, 9 Alley 5, Lane 12, Jen-Ai Road, Sec. 4, Taipei, China /Taiwan

[22] Filed: Sept. 13, 1974

[21] Appl. No.: 505,701

[52] U.S. Cl. ..... 52/251; 52/262; 52/442; 52/583

[51] Int. Cl.[2] ..... E04B 1/04

[58] Field of Search ..... 52/92, 250, 251, 259, 52/262, 432, 442, 586, 583

[56] References Cited

UNITED STATES PATENTS

| | | | |
|---|---|---|---|
| 880,154 | 2/1908 | Mueller | 52/442 |
| 963,368 | 7/1910 | Hall | 52/300 |
| 1,617,527 | 2/1927 | Knight | 52/586 |
| 1,988,388 | 1/1935 | Mioton | 52/92 |
| 2,817,965 | 12/1957 | Angelini | 52/562 |
| 3,258,888 | 7/1966 | Lam | 52/251 |
| 3,372,519 | 3/1968 | Russell | 52/262 |
| 3,416,277 | 12/1968 | Wood | 52/432 |
| 3,423,891 | 1/1969 | Barris | 52/250 |
| 3,706,168 | 12/1972 | Pilish | 52/262 |
| 3,867,805 | 2/1975 | Mikami | 52/259 |
| 3,902,291 | 9/1975 | Zacht | 52/300 |

FOREIGN PATENTS OR APPLICATIONS

| | | | |
|---|---|---|---|
| 1,396,224 | 3/1965 | France | 52/300 |
| 36,231 | 4/1930 | France | 52/432 |
| 1,006,748 | 4/1952 | France | 52/259 |
| 1,565,608 | 3/1969 | France | 52/438 |

*Primary Examiner*—Price C. Faw, Jr.
*Assistant Examiner*—Henry Raduazo
*Attorney, Agent, or Firm*—John J. Byrne; Edward E. Ayson

[57] ABSTRACT

A series of precast concrete links interconnect the upper ends of vertical wall panels and a precast roof. The links are formed with slots at their longitudinal ends for the reception of specially formed reinforcement members, as required by the design of the building under construction, and some of said links being formed with openings intermediate their ends.

10 Claims, 15 Drawing Figures

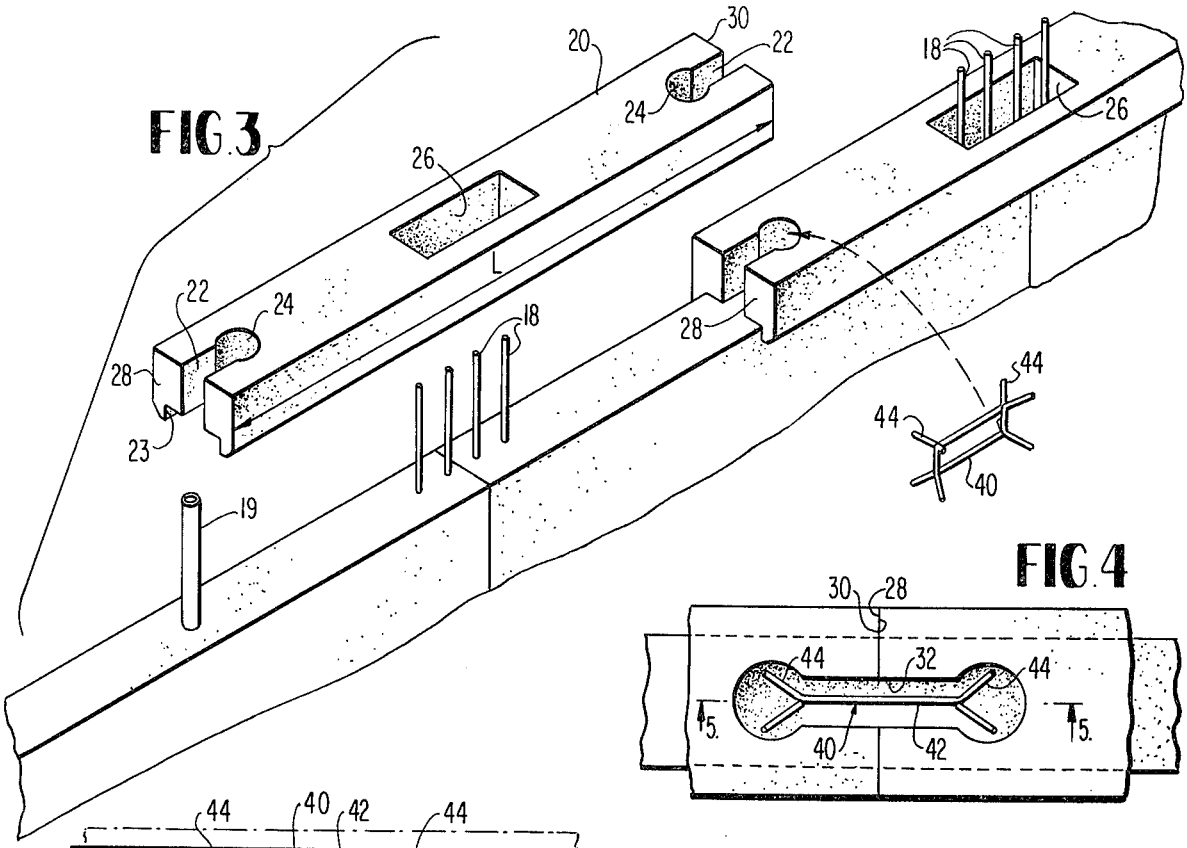
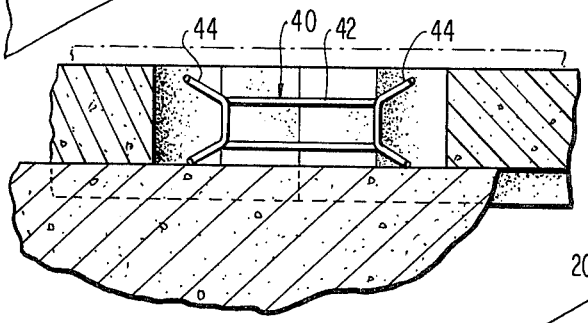
FIG. 5
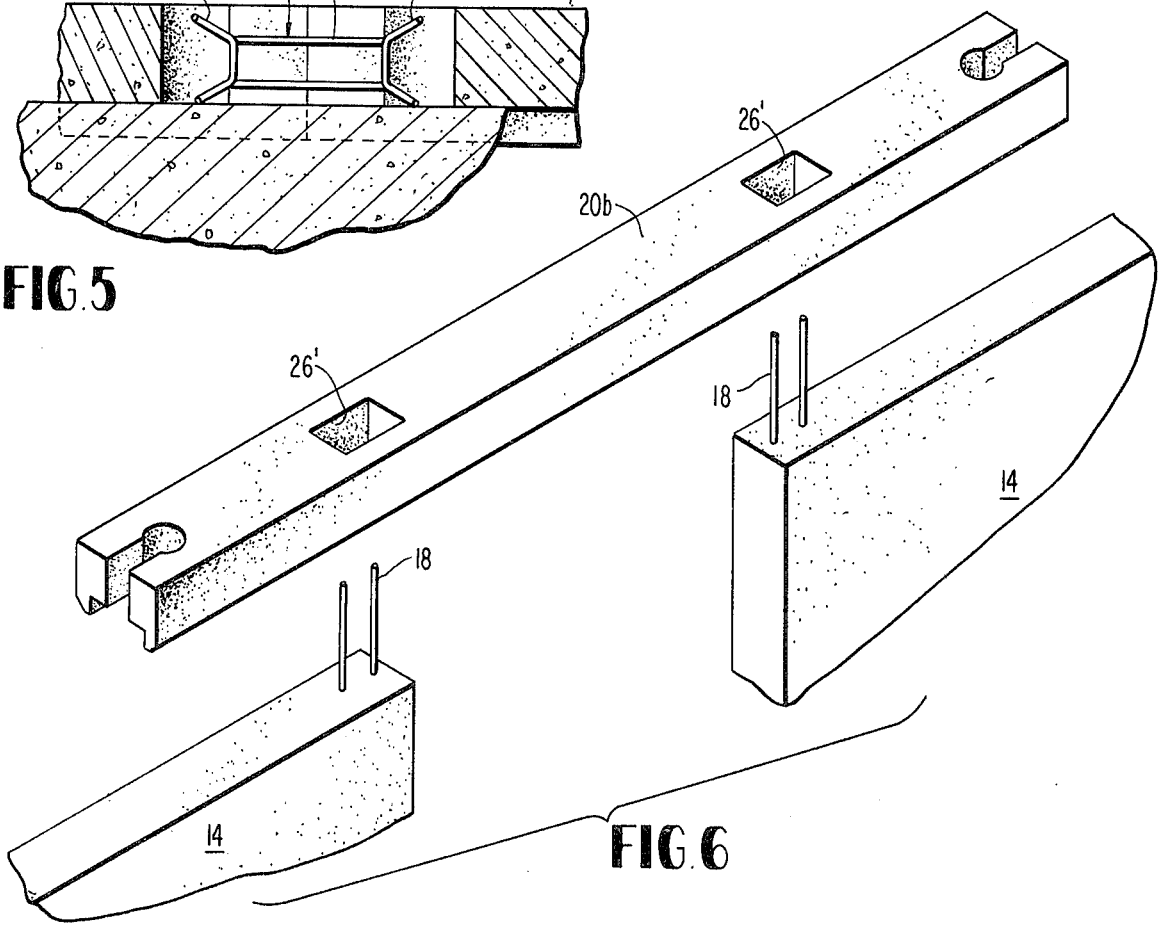
FIG. 6

FIG. 7a
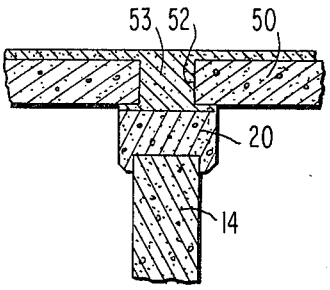
FIG. 7b
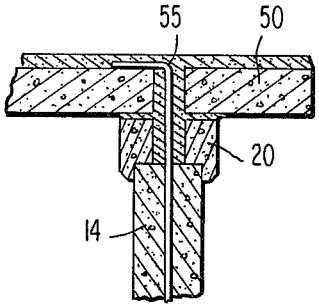
FIG. 7c
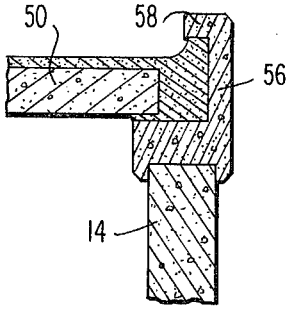
FIG. 7d
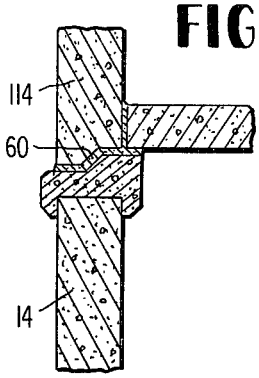
FIG. 8a
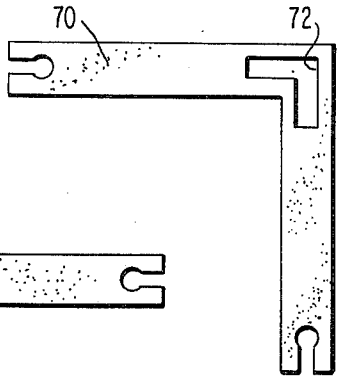
FIG. 8b
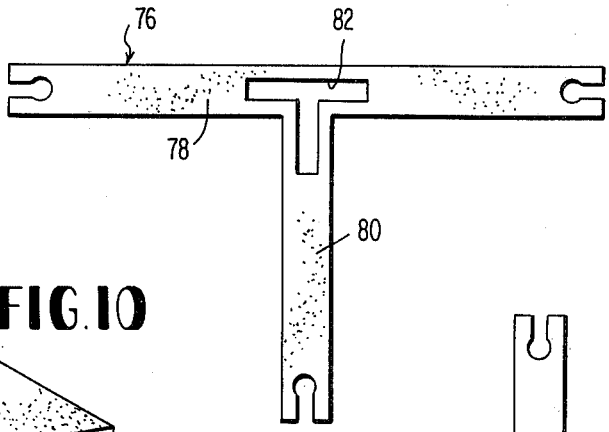
FIG. 10
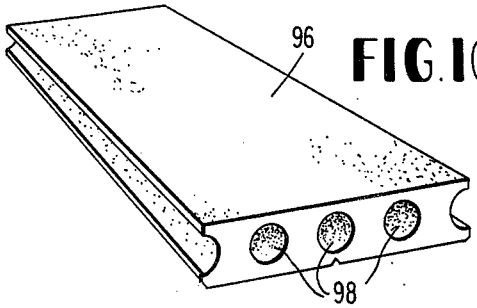
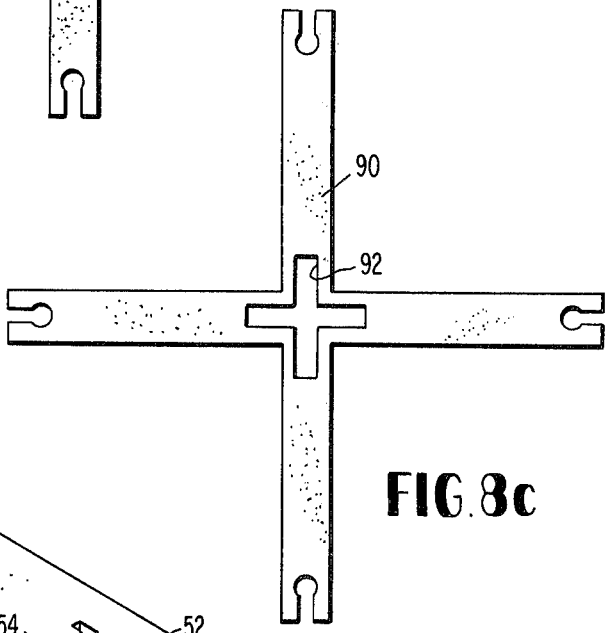
FIG. 8c
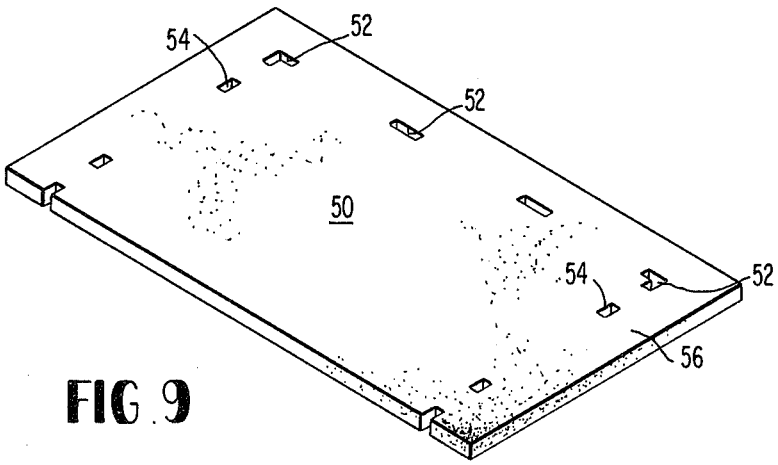
FIG. 9

BUILDING AND METHOD OF MAKING SAME

It is known in the construction trades to precast concrete walls and erect same. Normally, in such constructions, whether the walls are poured or precast, it is necessary that prior to pouring a roof slab, complicated forming construction is necessary which is both time-consuming and requires skilled carpenters. This is especially true when a roof overhang is desired.

A principal objective of this invention is to eliminate the need for such forming and provide a continuous bar about the upper surfaces of the walls so that a precast roof can be placed thereon.

A still further objective of this invention is to provide a unique link bar system to be received by the wall panels.

A still further objective of this invention is to provide a construction which cuts the cost and time of erecting houses and will not unduly restrict the imagination of its architectural design.

Another important objective of the invention is to provide a shelter preserving the above-identified objectives and concurrently providing space for electrical and other utility lines.

These and other objectives of the invention will become more apparent to those skilled in the art by reference to the following detailed description when viewed in light of the accompanying drawings wherein:

FIG. 3 is an exploded perspective view disclosing an example of a linking bar in its relationship to the top of a side wall;

FIG. 4 is an enlarged partial top plan view of a section of a building wall;

FIG. 5 is a side view of the elements shown in FIG. 4;

FIG. 6 is an exploded perspective of another linking bar in its relationship to the top of spaced side walls;

FIGS. 7*a*, 7*b*, 7*c*, and 7*d* are sectional views showing the elements in place;

FIGS. 8*a*, 8*b*, and 8*c* are views of linking bars having special application;

FIG. 9 is a perspective view of a roof section; and

FIG. 10 is a perspective view of another type of roof section.

Figure 1:
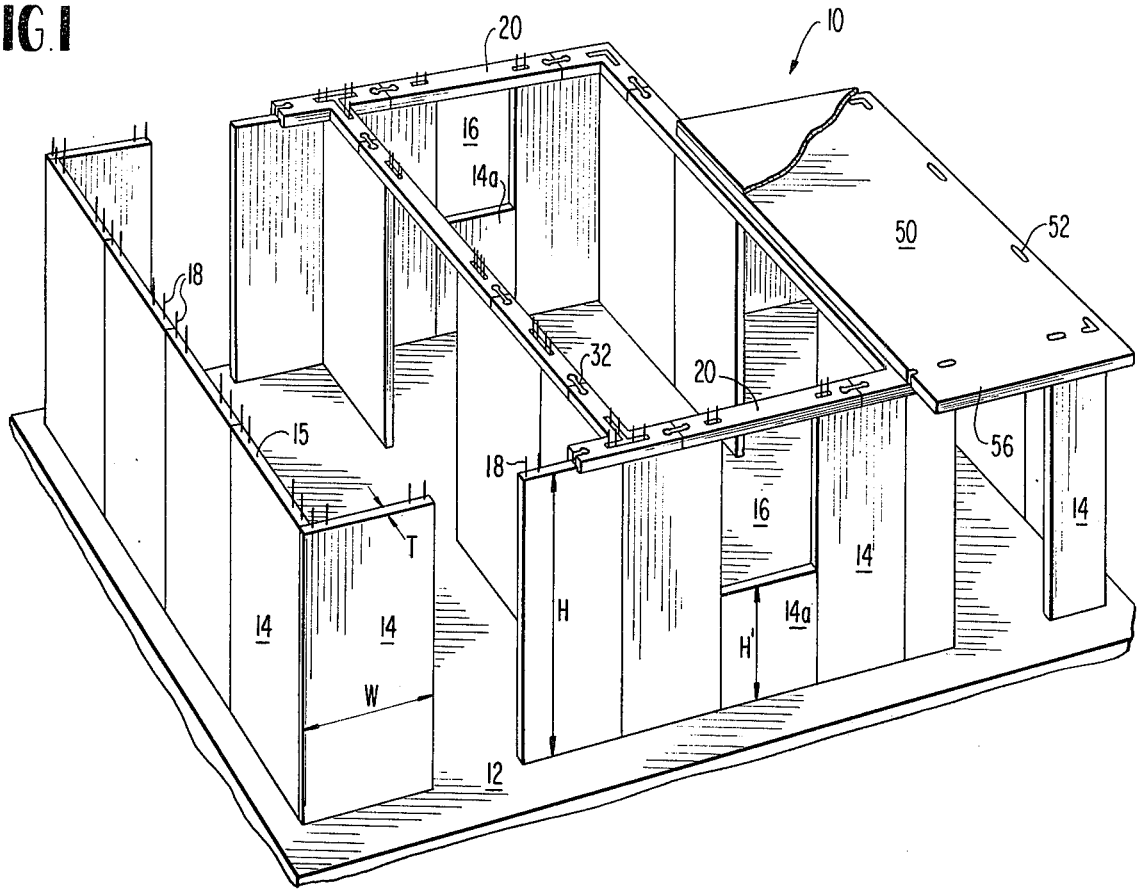
FIG. 1 is a partial perspective view showing a building which can utilize the principles of this invention.

Referring now to the drawings wherein the numerals indicate like parts, the numeral 10 indicates a building in a partially completed stage of construction comprising a slab or footing member 12 to which a series of precast concrete vertical wall sections 14 have been erected. At the stage of construction shown in FIG. 1, the wall sections 14, although connected to slab 12 at their lower ends, are oftentimes further supported with jack braces, not shown, until such time as a roof member is poured. As can be seen in FIG. 1, the panels 14 are of a width W, a height H and a thickness T. Some of the panels such as 14*a* have the same width W and thickness T as panels 14, but have a reduced height H'. The reduced height provides window openings and the like 16.

In prior art buildings a form is normally built about the upper ends 15 of the wall sections and concrete poured to form the roof. This forming is time-consuming and complicated and normally requires skilled labor. In order to eliminate the use of such in-place forming and pouring, this invention contributes linking bars 20.

Figure 2:
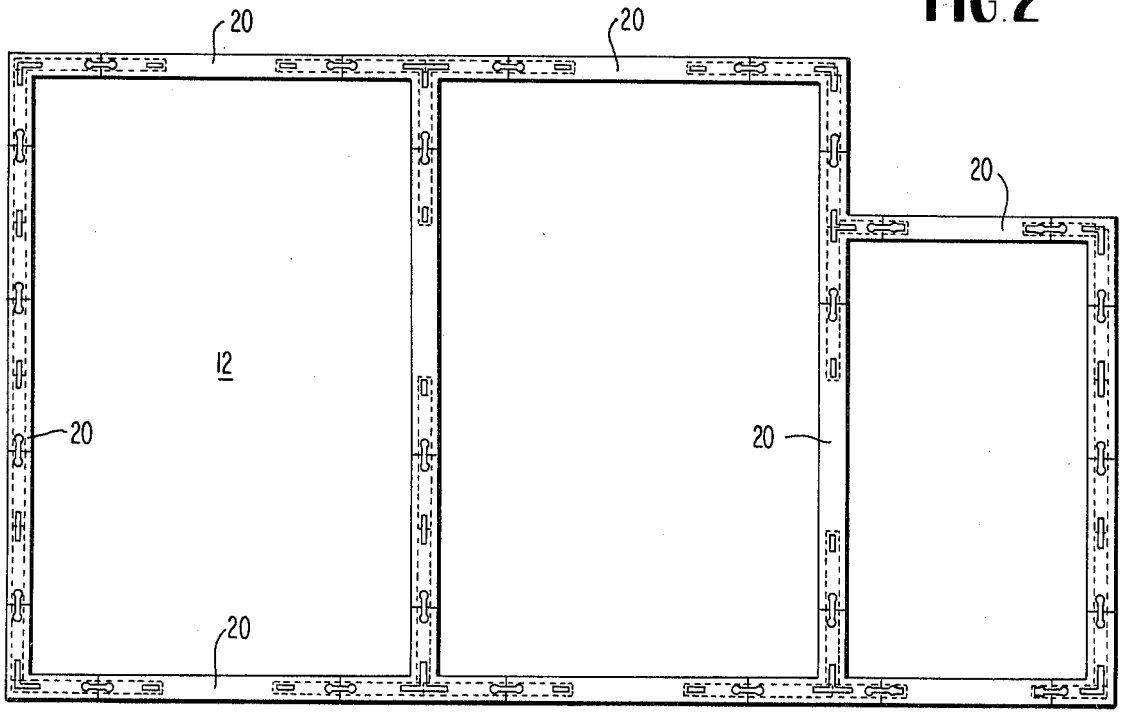
FIG. 2 is a plane view of such a construction.

As seen in FIGS. 1 and 2, panels 14 are cast or otherwise formed with reinforcing bars having bar extensions 18 protruding from the upper ends 15. The extensions 18 are effective to tie the roof into the rest of the structure. These reinforcing bar extensions are sometimes referred to as "lifting rods." This terminology is used because the extensions are used by crane equipment for lifting them into position.

Link bars 20 have a length L equal to the width W of the wall panels. At its longitudinal ends, each of the link bars is formed with key slots 22 leading to an enlarged opening 24. Intermediate the ends of linking bar 20 and spaced midway between the openings 24 is an elongated opening 26 for purposes hereinafter described. The link bars are grooved at 23 to receive the upper ends of the side walls.

As best seen in FIG. 3, panels 14 have their bar extensions 18 protruding from their upper edge near the vertical sides thereof. Some of the panels will also have a service conduit 19 embedded near the center thereof. Conduits 19 are utilized for receiving electric, telephone and other utility lines as may be required. The ends 28 and 30 of the linking bars are located at the vertical mid-points of the wall panels 14. In this fashion, the openings 26 are adapted to receive the reinforcing bar extensions 18 of adjacent panels. When slots 22 are juxtaposed adjacent to each other, the combination of slots 22 and 24 provides a dumbbell-shaped chamber 32 (see FIG. 4). Since chambers 32 are located over a midsection of the wall panels, they are adapted to receive conduits 19. The unique shape of chamber 32 also provides a specially designed space for receiving a reinforcing member 40 having an elongated narrow portion 42 for reception in slots 22 and flared portions 44 at either end thereof for reception by the openings 24. The bars of portion 42 are spaced sufficiently from one another so that when disposed 90° to that shown in FIG. 4 it can receive a conduit 19 therebetween.

With reference to FIG. 6 there is shown a double-length link bar 20*b* which is formed without a central opening 26 but with two smaller openings 26'. Link bars of this type are utilized where window and door openings such as window opening 16 and door opening 17 are traversed. In these instances, the link bars 20*b* act as lintels. A continuous series of link bars traverse the entire structure as seen in FIG. 2. This provides a base upon which a precast roof 50 is lowered and supported. The roof 50 can therefore be precast and lifted into position. The roof 50 is formed with apertures 52 and 54 for respective positioning over the chambers 32 and 26. The roof is constructed to have an overhang 56. To form overhangs with a conventional in-position, poured concrete entails considerable expense.

FIGS. 7*a*, 7*b*, 7*c* and 7*d* show link bar connections after a floor or roof 50 has been placed thereon. FIG. 8*a* shows a link bar 20, the roof 50, and a topping or covering material 53.

FIG. 8*b* is a view similar to FIG. 8*a* through an opening 52 that receives extensions 18. The extensions are bent at 55 prior to applying the topping 53. In FIG. 8*c* there is shown in cross-section a linking bar which is used on exterior walls when an overhang is not desired. In this instance, the link bar is formed with an upper extension 56 having a return 58. This design is used on exterior walls when an overhang is not desired. If there is to be an upper floor on the building under construction, the link bar is formed with the slanted step arrangement 60 as shown in FIG. 8*d*. Here, the bottom surfaces of upper walls 114 are shaped with a mating surface 62.

In addition to the link bars 20 and 20*b*, several other forms are necessary in order to efficiently construct a building. For corner sections, a link bar 70 is L-shaped and takes the form shown in FIG. 8*a*. In this instance the corner link bar 70 is also formed with an L-shaped opening 72. The link slot arrangement to form chambers 32 with abutting link bars remains the same. In FIG. 8*b* there is shown a link bar 76 adapted for use where one wall 14 abuts another. In this instance the link bar is formed of one elongated leg 78 and a second leg 80 perpendicular thereto. A corresponding T-shaped opening 82 is formed therein. Key slots are formed in each of the longitudinal ends so as to form chambers 32 with an abutting link bar.

FIG. 9*c* shows a cross-like link bar 90 which can be thought of as a member having the identical attributes of two link bars 20 but disposed perpendicular to one another at their midsections. The corresponding opening 92 is formed therein and each of its outer ends is formed with the linking key slots to form shaped chambers 32.

FIG. 10 is an embodiment of a roof construction. Here, a plurality of narrow slabs 96 replace the continuous room-size slab 50. The slabs are formed with channels 98 for lightness and to provide space for conduits where desired.

In a general manner, while there have been disclosed effective and efficient embodiments of the invention, it should be well understood that the invention is not limited to such embodiments as there might be changes made in the arrangement, disposition, and form of the parts without departing from the principle of the present invention as comprehended within the scope of the accompanying claims.

I claim:

1. A building of a type having exterior and interior walls formed of precast vertical panels of a selected width juxtaposed in a manner to provide the outline of the building and its interior partitioning, wherein some of said panels are spaced a panel width from its nearest panel to provide door openings, wherein a number of panels have less vertical height than others to provide window openings and wherein the remainder of said panels are of the same height such that their upper surfaces fall in the same horizontal plane, the improvement comprising, a plurality of linking bars of substantially rectangular configuration having lengths in multiples equal to the widths of said panels and positioned over said panels so that their respective ends are positioned at the mid-width points of said panels, said bars having linking slots at their ends formed by relatively narrow slots leading to enlarged sectors and wherein the adjacent narrow slots form a narrow passageway communicating the enlarged sectors thereof to form a chamber, a reinforcing member having a narrow midportion and enlarged ends for reception as a unit in said chamber, reinforcing bars embedded in said wall panels and having portions extending upwardly beyond the upper surface of said panel, said linking bars having openings intermediate their lengths for the reception of said portions, a precast roof supported by and extending over said linking bars and formed with roof openings disposed in vertical alignment with said intermediate openings of said linking bars.

2. The invention of claim 1 wherein said chambers are filled with concrete.

3. The invention of claim 1 wherein said first opening and said roof openings are filled with concrete.

4. The invention of claim 2 wherein said first opening and said roof openings are filled with concrete.

5. The invention of claim 1 wherein said roof is substantially larger than the planar outline of said panels whereby a roof overhang is provided to the building.

6. The invention of claim 1 wherein grooves are formed in the bottoms of said link bars and receive the upper edges of said panels.

7. The invention of claim 1 wherein at least some of said links are T-shaped.

8. The invention of claim 1 wherein at least some of said link bars are L-shaped.

9. The invention of claim 1 wherein at least some of said link bars are in the shape of a cross.

10. The invention of claim 1 wherein said linking bars are of solid, substantially rectangular configuration and wherein said linking slots extend the full thickness of said linking bars.

* * * * *